United States Patent [19]

Bouzianis et al.

[11] 4,344,199

[45] Aug. 17, 1982

[54] MACHINE FOR STIFFENING SHEET MATERIAL

[75] Inventors: George J. Bouzianis, Ipswich; John G. Hollick, Beverly; Donald B. McIlvin, Danvers; Frederick S. Sillars, Beverly, all of Mass.

[73] Assignee: USM Corporation, Farmington, Conn.

[21] Appl. No.: 163,220

[22] Filed: Jun. 26, 1980

[51] Int. Cl.[3] ..... A43D 11/00; B05B 7/06; B28B 3/00

[52] U.S. Cl. ..... 12/54.3; 118/315; 425/521

[58] Field of Search ..... 12/53.4, 53.5, 54.3, 12/54.2, 12.3, 12.5, 146 D; 118/315; 425/519, 520, 521

[56] References Cited

U.S. PATENT DOCUMENTS

| | | | |
|---|---|---|---|
| 3,138,810 | 6/1964 | Becker | 12/12.3 |
| 3,245,100 | 4/1966 | Choice et al. | 12/54.3 |
| 3,360,815 | 1/1968 | Forma | 12/12.5 |
| 3,464,073 | 9/1969 | Boddy | 12/54.3 |

*Primary Examiner*—Patrick D. Lawson
*Attorney, Agent, or Firm*—Donald N. Halgren

[57] ABSTRACT

A device for stiffening portions of sheets of flexible material including a reciprocable and rotatable nozzle disposed upon an extruder, the nozzle having a generally V-shaped nose section and a pair of wings disposed therebehind.

29 Claims, 9 Drawing Figures

4
1
2
6
7
58
91
61
49
32
C
21
22
47
70
72
71
93
S
64
66
65
67
68
23
99
25
28
37
31
30
36
38
3
39c
40
44
38a
39b
41a
45
46
38
41
39a
42a
38c
42
43
77
73
76
79
106
74
75
78
44

61
49
48
46
3R
17
C
44
S
40
41a
16
42a
83
46
47
41
42
82
39c
81
39
43
45
74
38
77
73
76
80
74a
106
75

61
49
46
3R
48
17
C
40
44
16
41a
83
46
82
47
41
42a
42
39c
81
43
39
45
38
73
74
75
77
80
74a
83
106

MACHINE FOR STIFFENING SHEET MATERIAL

FIELD OF THE INVENTION

The present invention relates to equipment for stiffening an area of flexible sheet material and particularly for lasting and stiffening a portion of a shoe upper.

BACKGROUND OF THE INVENTION

Stiffening of portions of shoe uppers by coating the portion to be stiffened with a layer of molten resin and solidifying the resin was disclosed in the U.S. patent to Chaplick et al. U.S. Pat. No. 3,316,573. In that patent, molten thermoplastic polymeric material was spread as a layer on a shoe upper at a temperature at which the thermoplastic material has a viscosity low enough to wet and adhere to the surface of the article to be stiffened but sufficiently high so that it will substantially not penetrate the shoe component. The layer of material so formed was cooled and shaped to form a stiff resilient layer holding the article in the desired configuration.

The U.S. patent to Hollick U.S. Pat. No. 4,127,910 discloses the stiffening of a selected area of sheet material such as a shoe upper through the use of a procedure of forming a layer of resin from a hot molten source which is particularly adapted for use in stiffening of heel end portions of the shoe upper. According to that patent, a molten resin is spread over an area of flexible sheet material to be stiffened by heat-pressing in which the sheet material is molded to a desired three dimensional shape and is then secured in lasted relation to an insole in a molding step in which the initial pressing and ultimate molding step are carried out while the resin is in a heat moldable state.

SUMMARY OF THE INVENTION

According to the present invention we have discovered a machine for stiffening an area of flexible sheet material with hot resin including a means for softening the resin into a flowable state and to apply the resin to the sheet material. The means includes a spreader nozzle having a plurality of orifices disposed thereon, the nozzle being rotatably disposed upon an extruder. The interior of the extruder is in fluid flow communication with the interior of the spreader nozzle and the extruder is in fluid flow communication with the softening means. In operation, the spreader nozzle is disposed against the sheet of flexible material, the sheet is tensioned against the nozzle and the nozzle is withdrawn. Simultaneously with the withdrawal, the heated resin is extruded upon the sheet. As the nozzle is being withdrawn, it is pivoted about an axis normal to the direction of reciprocation of the extruder so that the resin is deposited only on predetermined areas of the tensioned sheet in predetermined thicknesses. To compensate for different size areas of deposition and different sized sheets of flexible material, the nozzle is formed of a nose section disposed upon a hollow shaft, the shaft being connected to the extruder. At least one set of wing sections is disposed upon the shaft immediately behind the nose section and apertures are arranged in both the shaft and the wing sections so that when the wing sections are alligned behind the nose sections, the apertures will be in registry with each other and allow for the flow of thermoplastic material therethrough. When a smaller section of flexible material is being processed, these wings may be turned out of allignment behind the nose section and the apertures will be out of registry with each other and fluid flow will be interrupted.

DESCRIPTION OF THE PREFERRED EMBODIMENTS

Figure 1:
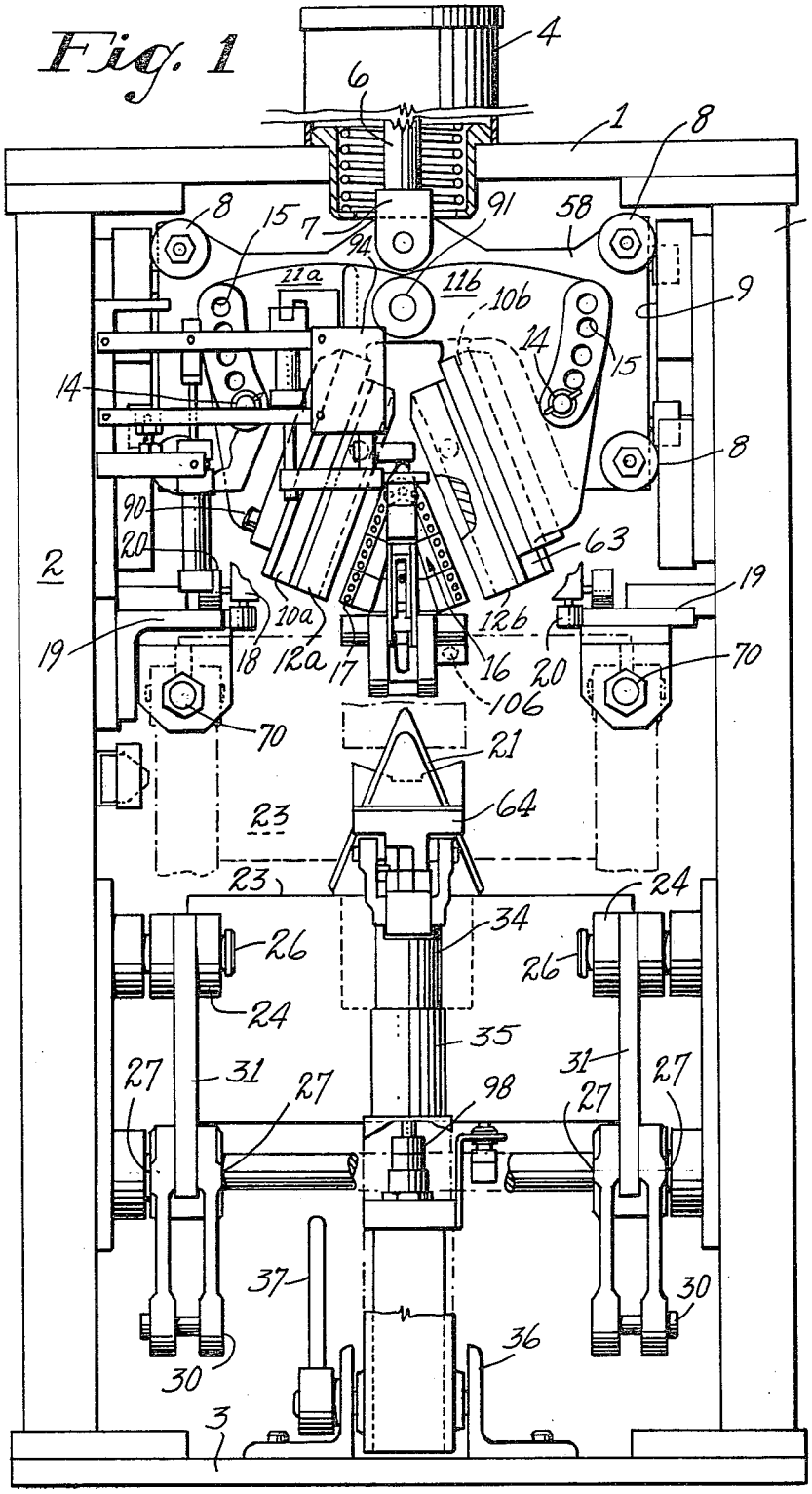
FIG. 1 is a front elevational view of a shoe molding machine and a mechanism for placing thermoplastic material upon the counter area of shoe uppers.
Figure 2:
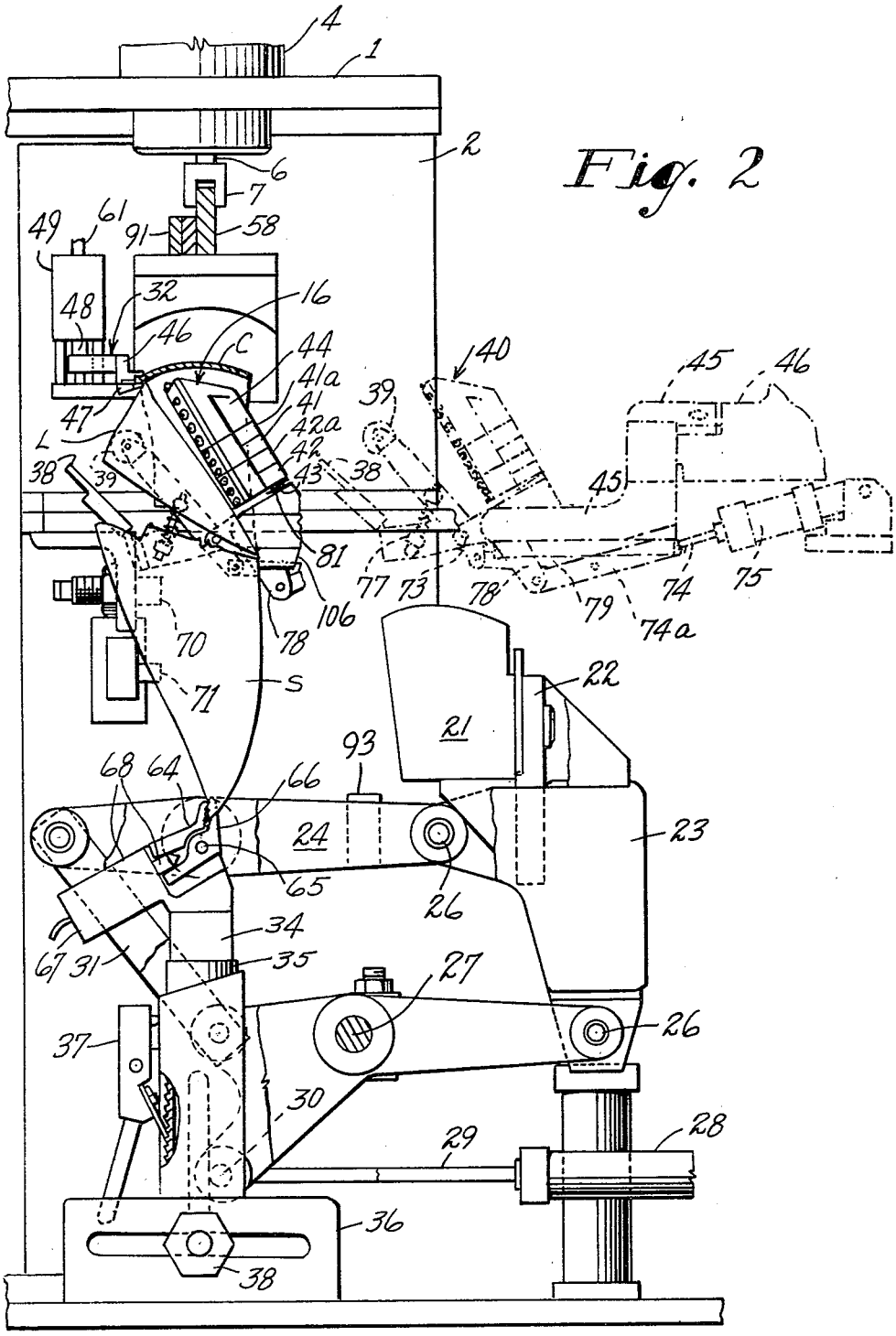
FIGS. 2 and 3 are side elevational views of the machine, shown in FIG. 1 and illustrating the movement of the spreader nozzle into the interior of the shoe upper.
Figure 3:
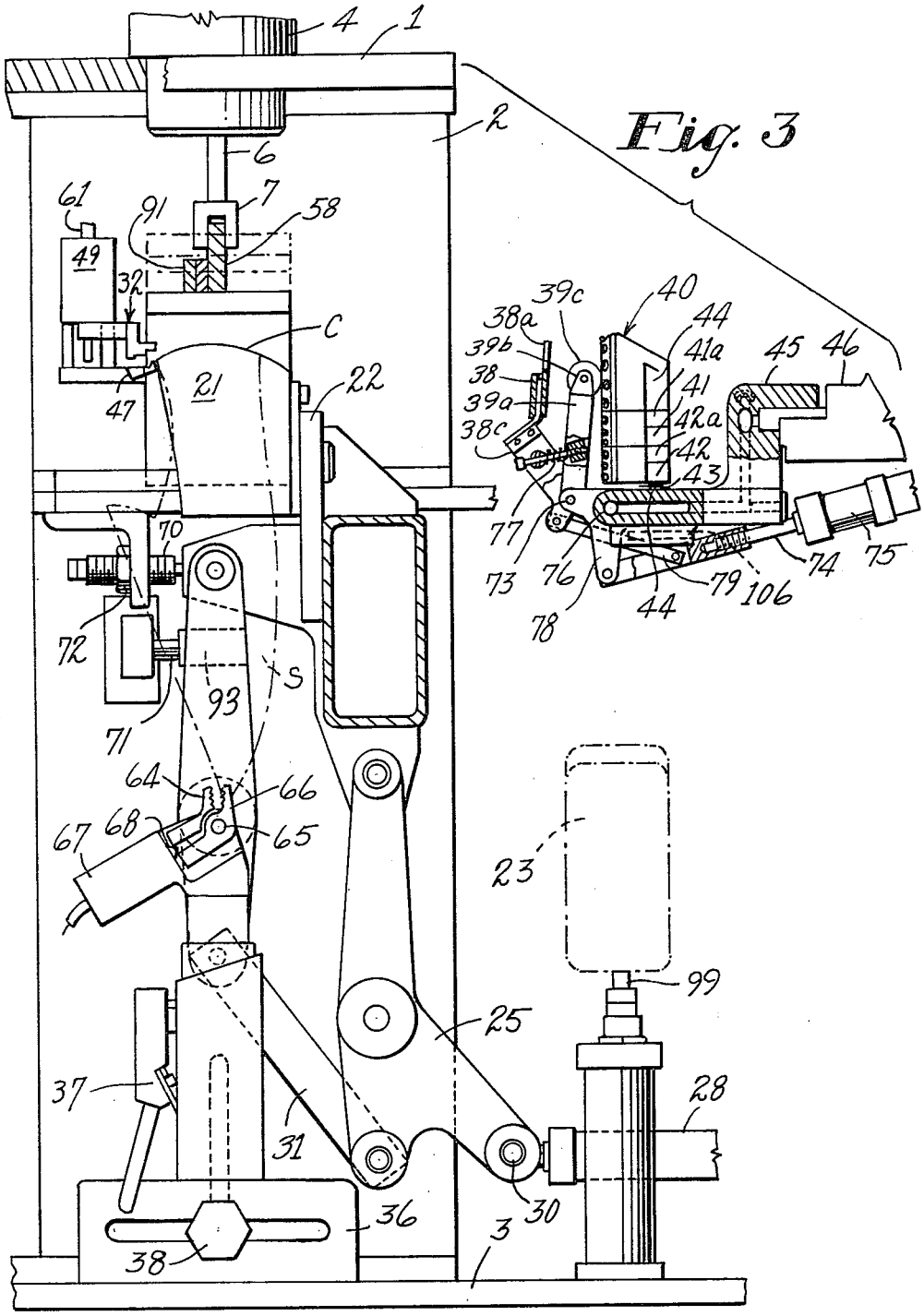
Figure 4:
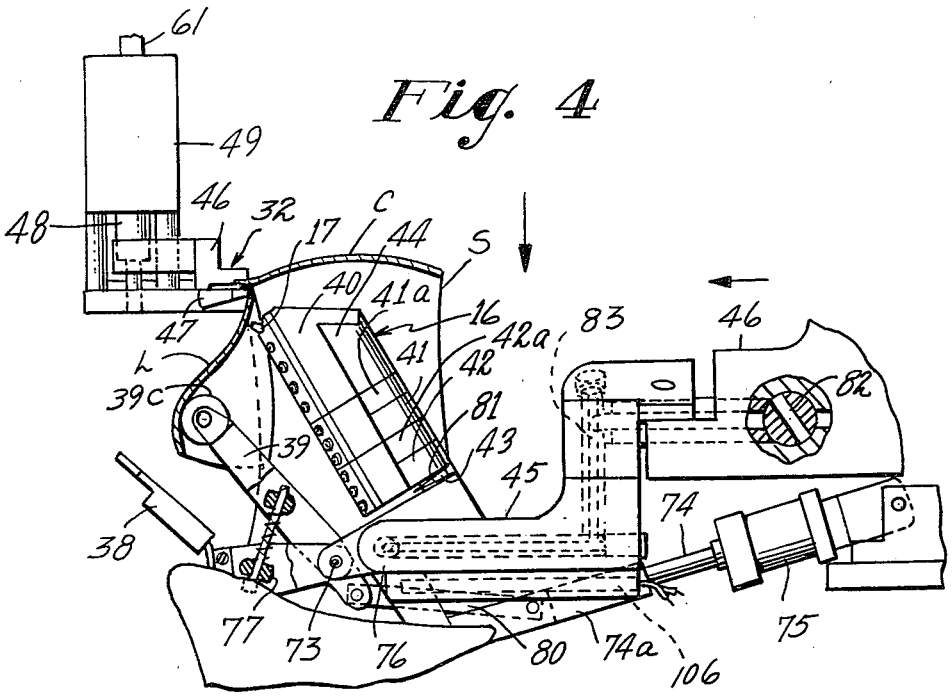
FIGS. 4 to 7 are enlarged cross sectional views of the spreader nozzle within the shoe upper and illustrating the steps for placing a layer of thermoplastic material upon the counter.

Referring now to FIGS. 1 to 3, the injection and molding equipment is disposed within a construction formed of an upper frame 1 which is held by uprights 2 that are bolted to base 3. A cylinder 4 has a piston rod 6 disposed therein in a conventional manner. A link 7 holds a U-shaped support 58 within the frame and rollers 8 riding on tracks 9 allow for vertical but not horizontal movement of the support 58. Female mold mount 11 is divided into two halves **11*a* and 11*b* and are arranged to swivel about pivot 91 so as to determine the angle between the female mold sections 12*a* and 12*b*. The angle can be set by manually adjusting the female mold section 12*a* and 12*b* and inserting pin 14 in the appropriate hole 15. The female mold sections 12*a* and 12*b* are slidably disposed in the female mold mounts 10*a* and 10*b*, the former including a kurf 63 that can be anchored to female mold mounts 10*a* and 10*b* by appropriate cap scews 90**.

A V-shaped spreader nozzle 16 having a plurality of orifices 17 is disposed about the perimeter thereof and is supported upon a carrier 18 that reciprocates upon rails 19 by means of wheels 20 which allow for motion in the horizontal plane.

As best seen in FIGS. 2 and 3, a male mold 21 is bolted to a support 22 which in turn is attached to a carrier 23. Carrier 23 is attached to an upper linkage 24 and lower linkage 25 pivoting about the four pivot points 26 and 27, respectively. A piston cylinder 28 has a rod 29 connected to pivot point 30 and retraction of rod 29 into cylinder 28 will draw linkage 25 toward it bringing carrier 23 upwardly while simultaneously pulling linkage 31 downwardly thereby swinging upper linkage 24 upwardly and directing male mold 21 into registry with female mold sections **12*a* and 12*b*. Such registry is obtained as support 22 engages stop 70 and abutment 93 touches sensor 71. Stop 70 may be manually adjusted by twisting knurled nut 72** so as to vary the depth into which the male mold enters the female mold.

In a preferred embodiment a shoe upper is worked upon by the equipment. The shoe upper S is formed of at least two sheets of flexible sheet material one of which is a lining L sewn to the upper S at the top line edge. The lining L can be moved from the inside of the shoe upper prior to disposition in an upper pincer 32. As shown in FIGS. 2 and 3, the nozzle 16 and extruder 45 are advanced into the female mold and into the interior of the shoe upper S. Finger 38 slides beneath the liner L in the entry stroke and roller 39 engages the interior of liner L to enable nozzle 16 to fit beneath the backpart of the upper.

Nozzle 16 is formed in a V-shape with a V-shaped nose section 40 and forward wings 41 and rear wings 42. All of these members are disposed upon a shaft 43. A spring biases the wings 41 and 42 against the nose section 40 to allow for their limited rotational movement about the shaft 43. An aperture (not shown) is formed in each of the wing sections 41 and 42 and can move into registry with matching apertures (not shown) on shaft 43. When wing sections 41 and 42 are disposed immediately behind nose section 40, the nozzle 16 is formed into a V-shaped configuration and the interior of wing sections 41 and 42 are in fluid flow communication with the interior of shaft 43 which in turn is in communication with the interior of an extruder 45. Extruder 45 is in fluid flow communication with a conventional thermoplastic softener. When the wing sections 41 and 42 are rotated so that all parts of the nozzle 16 are no longer in a V-configuration, the apertures within forward and rear wings 41 and 42 are out of registry with the apertures in shaft 43 and softened thermoplastic material cannot flow therein. It is to be pointed out that forward wing 41 is formed in two mating halves with only one side thereof being illustrated in the drawing. The other mating half can be rotated about the shaft 43 in a manner similar to the half which is shown. In a like manner, rear wing 42 also swings about the shaft 43. While the construction illustrated is for mannual adjustment, the movement can be mechanized through the addition of appropriate pistons or other motive devices. The design of the wings can enable the use of the extruder nozzle in a wide variety of shoe sizes heretofor not achievable with nozzles employed for the disposition of layers of thermoplastic material.

The back line pincer 32 utilizes a pair of jaws 46 and 47 mounted upon a support 94 attached to the frame 2. Upper jaw 46 is movable along a vertical axis through the actuation of a piston rod 48 that is housed within a cylinder 49. Air is fed through a line which urges upper jaw 46 downwardly against lower jaw 47. Preferably lower jaw 47 extends beyond the reach of upper jaw 46 so as to form a hanger for upper S. The entire assembly of cylinders 49 and jaws 46 and 47 can also be moved upwardly or downwardly through the action of piston rod 61 which is actuated by another cylinder.

Holding the toe end of the shoe upper S involves a movable jaw 64 that pivots about a point 65 disposed in jaw 66 and is arranged to grasp the toe of the shoe upper S. Movement of the movable jaw 64 is controlled through an air actuated cylinder 67 which extends arm 68 outwardly when operated to clamp movable jaw 64 against fixed jaw 66 to engage the shoe upper S. The entire assembly of the jaw 64 and 65 is disposed upon a mount 34 which is slidably housed in a sleeve 35. Fixed upward or downward movement of stand 34 is controlled by adjustment handle 37 and an associated racheting system which allows for a stepwise raising or lowering of the stand 34 and the toe pincer disposed thereon and also by piston rod and cylinder 98 which is actuated to draw the upper upon nozzle 16. Movement of the toe pincer on a horizontal plane is controlled by loosening or tightening nut 38 within stand 36 for an appropriate angular relationship of the shoe upper S as is dictated by its design and construction.

In the initial movement of the nozzle 16 toward the interior of shoe upper S, it can be seen in FIG. 2 (as shown in dotted lines) that the V-shaped spreader nozzle 16 is arranged at an oblique angle relative to the direction of motion of the extruder 45. Roller 39 is disposed immediately in front of spreader nozzle 16 and is arranged to pivot about a point 73 in response to motion from piston rod 74 housed in cylinder 75. An out-thrust of piston rod 74 will cause spreader nozzle 16 to rotate about a pivot point 76 and simultaneously cause roller 39 to pivot around the point 73. Finger 38 is coarticulated with roller 39 and will also move in response to piston rod 74. The spacing between finger 38 and roller 39 is controlled by movement of adjustment screw and nut 77 so as to provide for spacing of the two mechanisms to compensate for variations in shoe sizes.

As stated above, the nozzle 16 is angularly arranged relative to the direction of travel of the extruder 45. The finger 38 slides beneath the lining L of the upper and roller 39 engages the inside of liner L. Spreader nozzle 16 is then disposed nearly adjacent the counter area C of the shoe uppers. In the next step, upper pincer 32 moves in a downward direction so as to dispose back part C directly upon spreader nozzle 16 and at the same time toe pincer 66 draws the shoe upper S so as to maintain tension. Softened thermoplastic material is then extruded from the plurality of orifices 17 upon the back part C. Simultaneously, piston rod 74 is extended which causes spreader nozzle 16 to pivot about point 76 and simultaneously release the urging of roller 39 against liner L. As extruder 45 is withdrawn from the interior of the shoe upper, the finger 38 urges the liner L against the upper so as to ready it for subsequent molding.

In the next stage as shown in FIG. 3, piston rod 29 is retracted within cylinder 28 so as to draw linkage 25 and rotate carrier 23 from the phantom line portion to the upright node. A shock absorber/stop is disposed at the rest portion of the male mold 21. Thereafter movement places male mold 21 directly within shoe upper S for laminating the lining thereto. Female mold 12 is dropped downwardly through the urging of piston rod 6 around back part C and upon male mold 21 for a sufficient time to mold the counter C into the desired configuration. As shown in FIG. 2, the extruder 45 and spreader nozzle 16 have been retracted from within the molds and the spreader nozzle 16 is angled so as to be ready for a subsequent molding operation. Rod 74 is extended which pivots linkage 78 about point 76 and silultaneously moves linkage 79 to pivot roller 39 and finger 38 about point 73.

In FIGS. 4 to 7, the sequential operation of the spreader nozzle 16 is shown. Pincer 32 is operated by piston rod 48 and cylinder 49 and is shown to have engaged the sewn joint between upper S and liner L to hold it in place for the extruding operation. As shown, roller 39 is articulated so as to engage the inside of liner L and hold it back to allow softened thermoplastic material to flow from orifices 17 of the spreader nozzle 16. Roller 39 is coarticulated with finger 38 which passed beneath liner L during the entry stroke of extruder 45. Roller 39 and finger 38 are joined together by nut and screw adjustment 77 which is utilized to increase or decrease the space between the two parts. The radial motion of roller 39 and finger 38 is controlled by piston rod 74 through linkage 80 which causes these two members to pivot about point 73 and also produces radial movement of spreader nozzle 16 about point 76.

Figure 5:
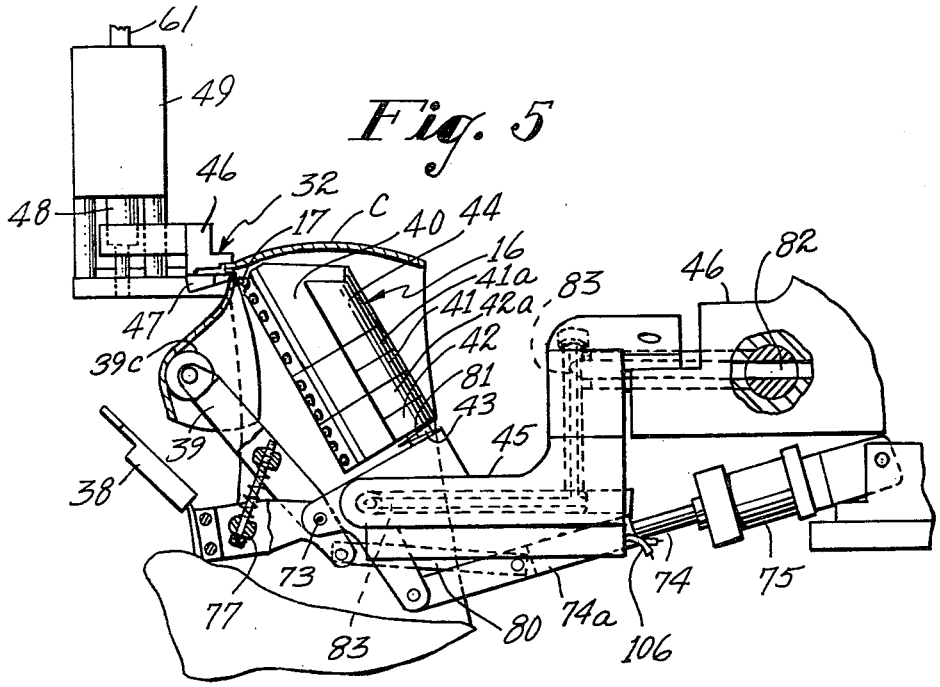

As the nozzle travels inwardly of the upper, valve 82 in extruder 45 is in a closed position. As shown in FIG. 5, valve 82 has been opened and softened thermoplastic material can pass from the conventional softener through bore 83 to reach spreader nozzle 16. Conventional heaters 106 are used to maintain the temperature of extruder 45 sufficiently high to maintain the thermoplastic material flowing therethrough in a molten state so that it can be extruded through orifices 17. When desired, heaters 106 are implanted within spreader nozzle 16 to keep the thermoplastic material molten.

Figure 6:
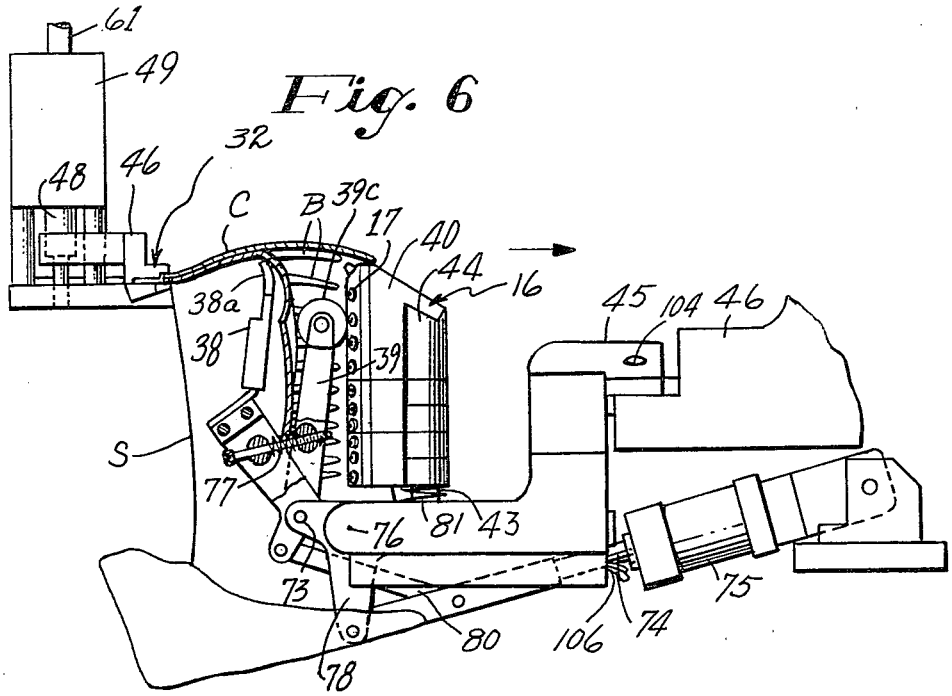
Figure 7:
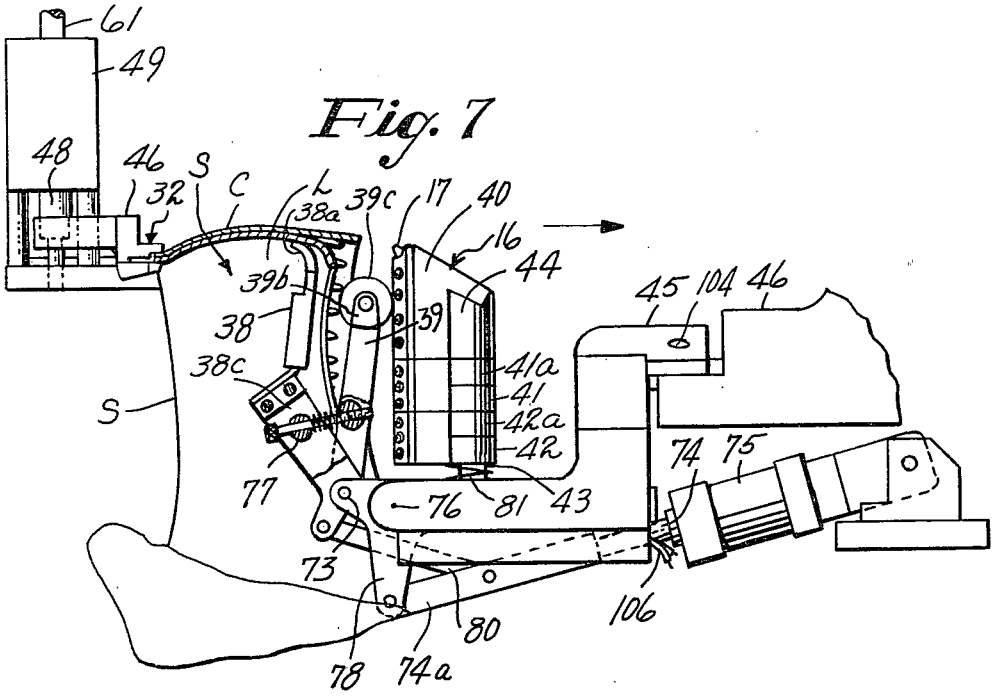

As shown in FIG. 6, the back part C has been drawn down about extruder nozzle 16 by the toe pincer (not shown) and finger 38 wipes liner L to secure it to back part C and from the beginning of a counter. Beads of thermoplastic material B have been laid down through orifices 17 upon the interior of the back part C while simultaneously spreader nozzle 16 is rotated counterclockwise from the obtusely-angled entry position shown in FIG. 4 to the right angled position shown in FIG. 6. At the same time roller 39 is coarticulated with finger 38 so as to move finger 38 into position to urge liner L against the beads of thermoplastic material B. In FIG. 7 the spreader nozzle 16 has been withdrawn from the shoe upper S and the finger 38 is shown making the final wipe upon the liner L. The shoe upper S is then ready for molding as shown in FIGS. 1 to 3 previously mentioned.

Figure 8:
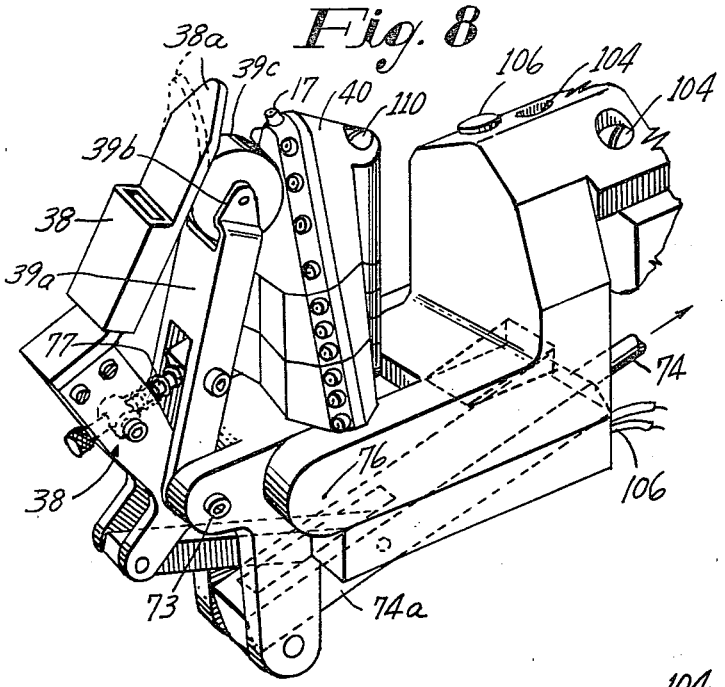
FIGS. 8 and 9 are enlarged perspective views of the spreader nozzle and applicator machine.
Figure 9:
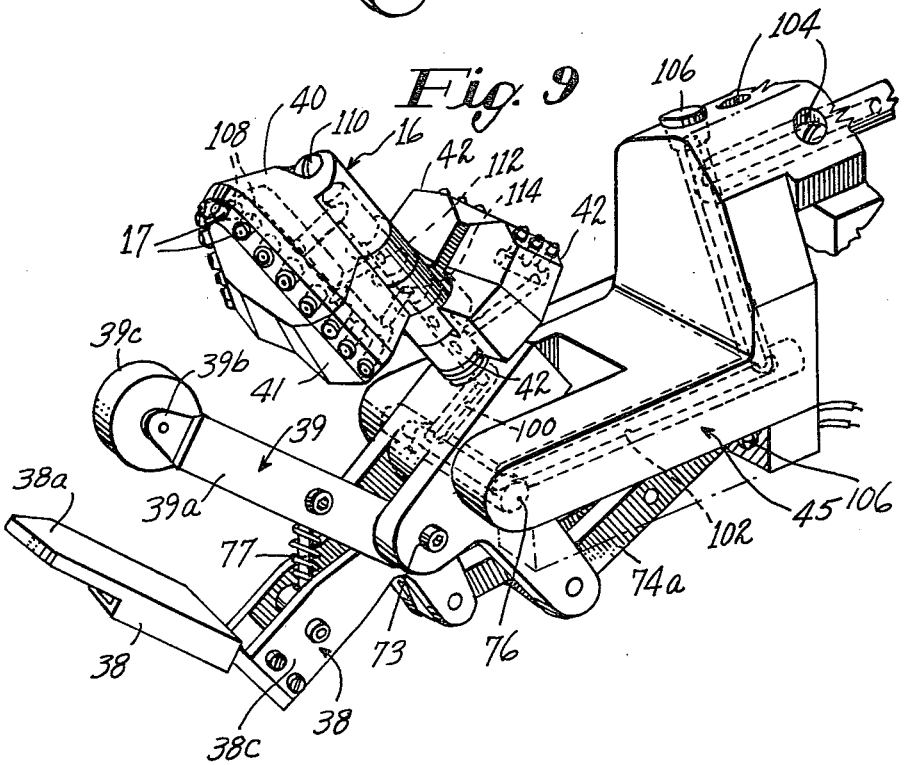

As shown in greater detail in FIGS. 8 and 9 the nozzle and extruder of the present invention include the nose 40 which is disposed at the end of a shaft (not shown). The nozzle 16 is pivotable about a point 76 and mounted upon a linkage 78, which allows it to rotate as required for the various steps of the molding operation. Internal bores within the nozzle connect the orifices 17 to a bore 100 within the linkage 78. The bore 100 is connected to a bore 102 disposed within the extruder 45 which in turn is bolted onto a conventional thermoplastic softening device (not shown) by means of screws 104. Small bores 108 connect the shaft which holds the nose 40 to the orifices 17. A screw 110 is fitted at the end of the shaft to enable the operator to clean the device. Apertures 112 and 114 connect the interior of the shaft to the forward wing sections 41 when these wing sections are swung into registry immediately behind the nose section 40. As shown by way of example in FIG. 9, the rear wing sections 42 can be swung around the shaft to place apertures similar to apertures 112 and 114 out of registry with the interior of the shaft. Of course, forward wing sections 41 can also be swung around the shaft.

When the linkage 74*a* (which is connected to a piston rod) is extended it will both rotate the nozzle 16 and also move roller 39 and finger 38. Finger 38 is preferably formed of a resilient material 38*a* seated and attached to a housing 38*b* which in turn is mounted upon a support 38*c*. Resilient material 38*a* has sufficient rigidity so as to be able to force the inner liner of the shoe against the counter and cause initial adherence. As finger 38 moves in a clockwise direction, roller 39 will index out of its initial location since the two elements are coarticulated at pivot point 73. Roller 39 includes a stem 39*a* with a yoke 39*b* and a wheel 39*c*. Roller 39 is separated from finger 38 in fixed position by a screw and spring arrangement 77. As the screw is rotated in a clockwise direction, the finger and roller are drawn nearer to each other so as to accommodate different styples of shoes. Since the distance between the finger 38 and roller 39 do not need to be changed frequently a simple mannually operated mechanism is adequate to achieve these results.

It is apparent that modifications and changes can be made within the spirit and scope of the present invention, but it is our intention only to be limited by the scope of the appended claims.

Having thus described our invention, what we claim as new and desire to secure by Letters Patent of the United States is:

1. A machine for stiffening an area of flexible sheet material with hot resin, said machine comprising:

means for softening said resin into a flowable state; and means for applying said resin to said sheet material, said means comprising a spreader nozzle rotatably disposed upon an extruder, said nozzle having a plurality of orifices disposed therein, the interior of said extruder being in fluid flow communication with the interior of said spreader nozzle and the interior of said extruder also being in fluid flow communication with said softening means so that softened resin can flow from said orifices; and means for effecting relative movement between said nozzle and said sheet material.

2. The machine according to claim 1, wherein the nozzle rotates about an axis normal to the direction of relative movement between said nozzle and said sheet material.

3. The machine according to claim 1, including means for preventing the flow of resin into predetermined orifices on said nozzle.

4. A machine for stiffening an area of flexible sheet material with hot resin, said machine comprising:

means for softening said resin into a flowable state; and a hollow V-shaped spreader nozzle having a plurality of orifices disposed on the perimeter thereof, said nozzle being rotatably disposed upon an extruder, the interior of said nozzle being in fluid flow communication with the interior of said extruder, said extruder being arranged in communication with said softening means;

means for effecting relative movement between said nozzle and said sheet material.

5. The machine according to claim 4, wherein the nozzle rotates about an axis normal to the direction of relative movement between said sheet material.

6. The machine according to claim 4, including means for preventing the flow of resin into predetermined orifices of said nozzle.

7. The machine according to claim 4, including means to prevent the flow of resin through predetermined orifices on said nozzle.

8. The machine according to claim 7, wherein the nozzle is disposed on a hollow shaft, and said hollow shaft is connected to said extruder, the interior of said nozzle being in fluid flow communication with the interior of said shaft, said nozzle being formed of a nose section disposed at the end of said shaft and at least one set of wing sections movably disposed on said shaft immediately behind said nose section, and said means for preventing the flow of resin being associated with said wing section.

9. The machine according to claim 8, wherein each of the wing sections are supported on sleeves which are rotatably disposed upon said shaft and further including apertures disposed in said shaft and in said sleeves, said apertures being arranged to be in registry with each other when said wing sections are disposed behind said nose section and be out of registry when said wing sections are rotated from behind said nose section.

10. A machine for stiffening an area of flexible sheet material with hot resin, said machine comprising:

means for softening said resin into a flowable state; and means for applying said resin to said sheet material, said means comprising a spreader nozzle disposed upon a shaft, said shaft being connected to an extruder and in fluid flow communication with said nozzle and said extruder, said spreader nozzle being formed of a nose section disposed at the end of said shaft and at least one set of wing sections rotatably disposed on said shaft immediately behind said nose section, said wing sections being arranged to permit the flow of resin therein when rotated to behind said nose section; and means for effecting relative movement between said nozzle and said sheet material.

11. A machine for stiffening a section of flexible sheet material with a hot resin, said machine comprising:

means for softening said resin into a flowable state; and a reciprocable extruder; and means for spreading said resin onto said sheet material, said spreading means being rotatably disposed on said reciprocable extruder;

means to rotate said spreading means about an axis normal to the direction of reciprocation of said extruder means during operation of said machine; and means for effecting relative movement between said spreading means and said sheet material.

12. The machine according to claim 11, including means for preventing the flow of resin into predetermined orifices of said spreading means.

13. The machine according to claim 12, wherein the spreading means is disposed on a hollow shaft, the interior of said spreader means being in fluid flow communication with the interior of said shaft, said spreader means being formed of a nose section disposed at the end of said shaft and at least one set of wing sections disposed on said shaft immediately behind said nose section, and said means for preventing the flow of resin being associated with said wing sections.

14. The machine according to claim 13, wherein each of said wing sections are supported on sleeves which are rotatably disposed upon said shaft and further including apertures disposed in said shaft and in said sleeves, said apertures being arranged to be in registry with each other when said wing sections are disposed behind said nose section and be out of registry when said wing sections are rotated from behind said nose section.

15. A spreader nozzle for applying hot resin comprising:

a hollow shaft;

a nose section disposed on the end of said shaft and a plurality of orifices disposed on said nose section;

at least one pair of wing sections having orifices formed therein said disposed upon said shaft and arranged to rotate about said shaft;

connection means disposed in said shaft between the interior of said wing sections and the interior of said hollow shaft, said connection means being arranged to be in fluid flow registry when said wing sections are disposed immediately behind said nose section and out of registry when said wing sections are rotated away from immediately behind said nose section.

16. The nozzle according to claim 15, wherein the wing sections are divided into a plurality of sets each member of each set being arranged to rotate about said shaft.

17. In a machine for stiffening an area between two layers of flexible sheet material, said machine comprising:

means for softening said resin into a flowable state; and means for applying said resin to said sheet material, said means comprising a spreader nozzle disposed on a reciprocable extruder, said nozzle having a plurality of orifices disposed therein, the interior of said extruder being in fluid flow communication with the interior of said nozzle;

means disposed in front of said nozzle to urge said two layers apart as said nozzle is extended therebetween and means disposed adjacent to said urging means to draw said two layers together upon retraction of said nozzle.

18. The machine according to claim 17, further including holding means for retaining said sheet material during operation thereof, said holding means being arranged to retain the sheet material on a plane transverse to the direction of travel of the reciprocable extruder.

19. The machine according to claim 18, wherein said urging means includes a roller means coarticulated with said drawing means said drawing means having a flexible finger disposed on the end thereof said urging and drawing means being arranged to rotate about an axis normal to the direction of travel of said reciprocable extruder.

20. In combination with complimentary-shaped male and female molds, at least one of said molds being movable relative to the other, said molds being arranged to shape, stiffen and laminate selected portions of flexible sheets of material, the improvement which comprises:

means to dispose at least one of said sheets within said female mold and means to tension one of said sheets while said sheets are disposed within said female mold; and means to soften a resin into a flowable state; and a reciprocable extruder having a spreader nozzle disposed at the end thereof and arranged to enter said female mold for depositing a quantity of said resin upon the tensioned sheet; and means connecting said extruder to said softening means; and means to pivot said spreader nozzle around said extruder.

21. The combination according to claim 20, wherein said tensioning means urges said tensioned sheet against said nozzle while said nozzle is withdrawing from said female mold.

22. The combination according to claim 20, further including heater means disposed in said nozzle to keep said resin in a flowable state during deposition upon said sheet.

23. The combination according to claim 20, wherein said nozzle has a plurality of outwardly extending orifices disposed upon the perimeter thereof.

24. In combination with complimentary shaped male and female molds, said female mold having a generally V-shaped internal construction, said molds being arranged to shape, stiffen and laminate selected portions of flexible sheets of material, the improvement which comprises:

means to dispose at least one of said sheets within said female mold and means to tension one of said sheets while said sheet is disposed within said female mold; and means to soften a resin into a flowable state; and a reciprocable extruder with a nozzle disposed on the end thereof and arranged to enter said female mold and deposit a quantity of said resin upon portions of the tensioned sheet; and means connecting said extruder to said softening means; and means to pivot said nozzle around said extruder; and means disposed on the extruder to urge one side of the untensioned sheet and move it from the path of the extruder during an entry stroke and means on said extruder to draw the other side of the untensioned sheet and replace the untensioned sheet adjacent to the tensioned sheet during the withdrawal stroke of the extruder; and means connecting said extruder to said softening means; and means to pivot said applicator around said extruder during the withdrawal stroke of said applicator.

25. The machine according to claim 24, wherein the nozzle rotates about an axis normal to the direction of reciprocation of said extruder.

26. The machine according to claim 25, including means for preventing the flow of resin into predetermined orifices of said nozzle.

27. The machine according to claim 26, including means to prevent the flow of resin through predetermined orifices on said nozzle.

28. The machine according to claim 27, wherein the nozzle is disposed on a hollow shaft, and said hollow shaft is connected to said extruder, the interior of the nozzle being in fluid flow communication with the interior of said shaft, said nozzle being formed of a nose section disposed at the end of said shaft and at least one set of wing sections movably disposed on said shaft immediately behind said nose section, and said means for preventing the flow of resin being associated with said wing sections.

29. The machine according to claim 28, wherein each of the wing sections are supported on sleeves which are rotatably disposed upon said shaft and further including apertures disposed in said shaft and in said sleeves, said apertures being arranged to be in registry with each other when said wing sections are disposed behind said nose section and be out of registry when said wing sections are rotated from behind said nose section.

* * * * *

UNITED STATES PATENT OFFICE

CERTIFICATE OF CORRECTION

Patent No. 4,344,199 Dated August 17, 1982

Inventor(s) Bouzianis et al.

It is certified that error appears in the above-identified patent and that said Letters Patent are hereby corrected as shown below:

Column 7 - Claim 15, Line 61 - Replace "said" first occurrence with -- and --.

Signed and Sealed this

Twelfth Day of October 1982

[SEAL]

Attest:

GERALD J. MOSSINGHOFF

Attesting Officer

Commissioner of Patents and Trademarks